US012317918B2

(12) United States Patent
Stefani et al.

(10) Patent No.: US 12,317,918 B2
(45) Date of Patent: Jun. 3, 2025

(54) WRAPPER FOR AEROSOL DELIVERY PRODUCTS AND AEROSOL DELIVERY PRODUCTS MADE THEREFROM

(71) Applicant: Schweitzer-Mauduit International, Inc., Alpharetta, GA (US)

(72) Inventors: Bruno Stefani, Le Mans (FR); Lanig Le Bec, Tregunc (FR)

(73) Assignee: SWM Holdings US, LLC, Atlanta, GA (US)

( * ) Notice: Subject to any disclaimer, the term of this patent is extended or adjusted under 35 U.S.C. 154(b) by 243 days.

(21) Appl. No.: 17/677,432

(22) Filed: Feb. 22, 2022

(65) Prior Publication Data

US 2022/0264937 A1 Aug. 25, 2022

Related U.S. Application Data

(60) Provisional application No. 63/152,140, filed on Feb. 22, 2021.

(51) Int. Cl.

| | |
|---|---|
| ***A24D 1/02*** | (2006.01) |
| ***A24D 1/20*** | (2020.01) |
| ***D21H 17/64*** | (2006.01) |
| ***D21H 17/68*** | (2006.01) |
| ***D21H 19/34*** | (2006.01) |
| ***D21H 21/34*** | (2006.01) |

(52) U.S. Cl.

CPC ..... *A24D 1/02* (2013.01); *A24D 1/20* (2020.01); *D21H 17/64* (2013.01); *D21H 17/68* (2013.01); *D21H 19/34* (2013.01); *D21H 21/34* (2013.01)

(58) Field of Classification Search

CPC . A24D 1/02; A24D 1/025; A24D 1/20; A24C 5/01

See application file for complete search history.

(56) References Cited

U.S. PATENT DOCUMENTS

| | | | |
|---|---|---|---|
| 4,461,311 | A | 7/1984 | Mathews et al. |
| 4,739,775 | A | 4/1988 | Hampl, Jr. |
| 5,417,228 | A | 5/1995 | Baldwin et al. |

(Continued)

FOREIGN PATENT DOCUMENTS

| | | | |
|---|---|---|---|
| CN | 110284370 | A | 9/2019 |
| CN | 110629583 | A | 12/2019 |

(Continued)

OTHER PUBLICATIONS

Anthony Bristow, "The Surface of Paper", Chapter 8, pp. 209-232, in Pulp and Paper Chemistry and Technology (Edited by Monica Ek, Göran Gellerstedt, Gunnar Henriksson; ISBN 978-3-11-021345-4), copyright 2009. (Year: 2009).*

(Continued)

*Primary Examiner* — Manley L Cummins, IV

(74) *Attorney, Agent, or Firm* — Dority & Manning, P.A.

(57) ABSTRACT

A wrapper well suited for use in aerosol delivery products, such as heat but not burn sticks is disclosed. The wrapper includes a base web made from cellulosic fibers combined with filler particles. The base web can be coated on at least one side with a permeability reducing composition and/or treated with a flame retardant salt. The base web is constructed with a basis weight, bulk, and permeability so as to produce aerosol delivery sticks with low combustion characteristics.

21 Claims, 2 Drawing Sheets

(56) References Cited

U.S. PATENT DOCUMENTS

| | | | | |
|---|---|---|---|---|
| 5,921,249 | A * | 7/1999 | Hampl, Jr. | A24D 1/02 131/365 |
| 9,578,897 | B2 | 2/2017 | Gladden et al. | |
| 10,258,078 | B2 * | 4/2019 | Peterson | A24D 1/025 |
| 10,470,489 | B2 * | 11/2019 | Herve | D21H 19/36 |
| 2004/0134631 | A1 | 7/2004 | Crooks et al. | |
| 2016/0073686 | A1 * | 3/2016 | Crooks | A24D 3/10 131/331 |
| 2021/0120867 | A1 * | 4/2021 | Sakurai | A24F 40/20 |
| 2021/0274831 | A1 * | 9/2021 | Turtola | D21H 19/34 |
| 2022/0039458 | A1 * | 2/2022 | Lavanchy | D21H 19/04 |

FOREIGN PATENT DOCUMENTS

| | | | | |
|---|---|---|---|---|
| EP | 3446573 | A1 * | 2/2019 | A24D 1/02 |
| KR | 102022909 | B1 * | 9/2019 | A24D 1/045 |
| WO | WO02/37991 | A1 | 5/2002 | |
| WO | WO2009/006570 | A2 | 1/2009 | |
| WO | WO2011/117750 | A2 | 9/2011 | |
| WO | WO-2013170028 | A1 * | 11/2013 | A24B 15/186 |
| WO | WO2019/219869 | A1 | 11/2019 | |
| WO | WO2020/020503 | A1 | 1/2020 | |
| WO | WO2020/115150 | A1 | 6/2020 | |

OTHER PUBLICATIONS

English Machine Translation of CN-110629583-A, 2019. (Year: 2019).*

KR 102022909's English Translation (Year: 2019).*

International Search Report Corresponding to Application No. PCT/IB2022/051559 on May 27, 2022.

* cited by examiner

WRAPPER FOR AEROSOL DELIVERY PRODUCTS AND AEROSOL DELIVERY PRODUCTS MADE THEREFROM

RELATED APPLICATIONS

The present application is based upon and claims priority to U.S. Provisional Patent Application Ser. No. 63/152,140, having a filing date of Feb. 22, 2021, and which is incorporated herein by reference.

BACKGROUND

Smoking articles such as cigarettes are conventionally made by wrapping a column of tobacco in a wrapping paper. At one end, the smoking article usually includes a filter through which the article is smoked. Filters are attached to smoking articles using a tipping paper which is glued to the white wrapping paper. The wrapping papers and tipping papers used to construct smoking articles are typically made from wood or other cellulosic fibers and can contain one or more fillers, such as calcium carbonate.

When a smoking article is smoked, mainstream smoke is generated that is inhaled through the filter. Mainstream smoke can contain numerous different components that provide the smoking article with a particular taste, which encompasses the sensations detected not only by one's taste but also by one's sense of smell. In addition to producing mainstream smoke, conventional smoking articles also produce a sidestream smoke. Smoke exhaled by the smoker and the sidestream smoke is typically referred to as secondhand smoke.

In the past those skilled in the art have created heated tobacco products that can generate an aerosol and provide the similar experience to a user as a conventional cigarette while producing no secondhand smoke. These types of smokeless products are typically referred to as heat but not burn sticks. Heat but not burn sticks are placed in an aerosol generating machine and subjected to low temperature heating that produces an inhalable aerosol without combusting the product. For instance, a heat but not burn stick can contain tobacco that is heated to produce an aerosol without burning the tobacco. The heat but not burn sticks, similar to conventional smoking articles, contain a column of an aerosol generating material surrounded by a wrapper. The aerosol generating material can be made in different formats, such as cut strands from different sheets similar to cigarettes, from a gathered sheet of material, from an extruded cylinder of material, or from cut strands from a single sheet. The heat but not burn stick can be placed in a heating device that heats the stick to a temperature of from, for example, about 200° C. to about 350° C. The heating device, for instance, can use an electric element, can burn fuel, or can create a chemical reaction that produces the heat.

In contrast to conventional smoking articles, heat but not burn sticks should be non-combustible. In particular, heat but not burn sticks should not be capable of maintaining a lit end when exposed to an open flame or a heating element, such as an electrical lighter. For example, ideally, heat but not burn sticks should not be capable of being lit and smoked similar to a conventional cigarette. In addition, heat but not burn sticks preferably do not produce any significant amount of combustion products when placed in a heat but not burn device. Further, various governmental regulations now require that heat but not burn sticks not be capable of being used as conventional cigarettes.

In order to address the above concerns, in the past, wrappers for heat but not burn sticks have been made by laminating aluminum to a paper substrate. In addition, the aluminum adds significant expense to the product and is non-biodegradable.

In view of the above, a need exists for an improved wrapper for heat but not burn sticks. In particular, a need exists for an improved wrapper that can render a heat but not burn stick non-combustible.

SUMMARY

In general, the present disclosure is directed to a wrapper for use in constructing aerosol delivery products, such as heat but not burn sticks. In one aspect, the wrapper produces a non-combustible product when surrounding a column of tobacco and placed in a conventional smoking machine and ignited. The wrapper of the present disclosure can be made primarily from biodegradable materials and thus is environmentally friendly. In addition, the wrapper can be constructed so as to not adversely interfere with the aerosol producing characteristics of an aerosol generating material contained within the aerosol delivery product.

In accordance with the present disclosure, in order to produce a wrapper that can produce a non-combustible product, various different parameters of the wrapper are controlled within certain tolerance limits. It was discovered that by adjusting and controlling various different parameters, the combination of properties can provide the wrapper with the desired non-combustible characteristics. For example, in one embodiment, the wrapper contains cellulosic fibers combined with a flame retardant filler. The amount of filler present in the web, the basis weight of the web, the bulk of the web, and the inherent permeability of the web has been found to produce a wrapper that is particularly well suited for use in producing heat but not burn sticks and other aerosol products. Optionally, the web can also include a coating and/or a phosphorus-based flame retardant. Alternatively, the wrapper is produced with particular characteristics and includes a coating in combination with a phosphorus-based flame retardant. The phosphorus-based flame retardant can be impregnated into the paper or can be incorporated into the coating.

In one aspect, the present disclosure is directed to a wrapper for an aerosol delivery product, such as a heat but not burn stick. The wrapper comprises a base web containing cellulosic fibers blended with a flame retardant filler. The base web has a first side and a second and opposite side. The flame retardant filler can be present in the base web (uncoated web) in an amount from about 15% by weight to about 55% by weight, such as from about 18% by weight to about 52% by weight. In one aspect, the flame retardant filler is present in the base web in an amount less than 50% by weight. The base web has a bulk of less than about 2.0 cc/g, such as less than about 1.7 cc/g, such as less than about 1.5 cc/g, such as less than about 1.2 cc/g, such as less than about 1.1 cc/g, such as less than about 1 cc/g, and generally greater than about 0.6 cc/g, such as greater than about 0.7 cc/g. In one aspect, the bulk is from about 0.85 cc/g to about 1.05 cc/g. The base web (uncoated) has a basis weight of from about 30 gsm to about 85 gsm, such as from about 40 gsm to about 80 gsm, such as from about 45 gsm to about 75 gsm.

The base web can have an inherent permeability of less than about 100 mL/min, such as less than about 85 mL/min, such as less than about 70 mL/min, such as less than about 55 mL/min, such as less than about 40 mL/min, such as less than about 30 mL/min, such as less than about 20 mL/min, such as less than about 15 mL/min. The permeability can be greater than about 5 mL/min, such as greater than about 10 mL/min, such as greater than about 25 mL/min.

The base web can have an inherent porosity of less than about 10 CORESTA units (CU), such as less than about 8 CU, such as less than about 5 CU. As used herein, an "inherent" porosity or permeability refers to the porosity or permeability of the base web prior to applying any coatings or surface treatments (such as perforations).

The wrapper can optionally further include a coating disposed on the first side of the base web. The coating comprises a permeability reducing composition. The permeability reducing composition, for instance, can comprise a microcrystalline cellulose gel, an alginate, a starch, a cellulose derivative, or mixtures thereof.

In another aspect, the wrapper can optionally include a phosphorus-based flame retardant impregnated into the uncoated or coated wrapper. The phosphorus-based flame retardant, for instance, can comprise a monosodium phosphate, a disodium phosphate, a monoammonium phosphate, or the like. In still another embodiment, the phosphorus-based flame retardant can be incorporated into a coating applied to the wrapper. For instance, the phosphorus-based flame retardant can be combined with a permeability reducing composition.

The flame retardant filler present in the base web can comprise clay particles, silicate particles, metal hydroxide particles, and the like. For example, the flame retardant filler can comprise kaolin particles, aluminum hydroxide particles, calcium silicate particles, or mixtures thereof. The flame retardant filler particles can have an average particle size of from about 0.1 microns to about 30 microns, such as from about 2 microns to about 15 microns. As used herein, the particle size of the fillers can be determined through light scattering or laser diffraction. Such particle size analyzers are available commercially through Horiba Scientific, such as the LA-960 particle size analyzer.

The coating of the permeability reducing composition can be a continuous coating or a discontinuous coating. As used herein, a continuous coating is a coating that is uninterrupted over the treated area of the substrate. A discontinuous coating, on the other hand, is a coating that is interrupted over the treated area forming untreated areas within the treated areas. A wrapper that includes a plurality of spaced apart circumferential bands formed by a coating composition, for instance, is a discontinuous coating as used herein.

When the coating is a continuous coating, the coating can cover generally greater than about 20%, such as greater than about 40%, such as greater than about 65%, such as greater than about 80%, such as greater than about 85%, such as greater than about 90%, such as greater than about 95% of the surface area of the first side of the base web. Where the coating is disposed, the coating can have a basis weight of from about 0.5 gsm to about 10 gsm.

The coated base web can have a permeability of less than about 25 mL/min, such as less than about 18 mL/min, such as less than about 15 mL/min, such as less than about 12 mL/min, such as less than about 10 mL/min, such as less than about 8 mL/min, such as less than about 6 mL/min, such as less than about 4 mL/min. The permeability can be greater than 0 mL/min, such as greater than about 0.1 mL/min, such as greater than about 1 mL/min.

The coated base web can have a porosity of generally less than about 3 CU, such as less than about 2 CU.

When present, the phosphorus-based flame retardant can be impregnated into substantially the entire surface area of the wrapper or in select areas of the wrapper. For instance, the phosphorus-based flame retardant can be impregnated into bands or portions of the wrapper (e.g. applied in a pattern).

When the phosphorus-based flame retardant is impregnated into the wrapper, the phosphorus-based flame retardant can impregnate generally greater than about 20%, such as greater than about 40%, such as greater than about 65%, such as greater than about 80%, such as greater than about 85%, such as greater than about 90%, such as greater than about 95% of the surface area of the base web. The phosphorus-based flame retardant impregnated into the wrapper can be added at a basis weight of from about 0.5 gsm to about 10 gsm.

In still another embodiment, the phosphorus-based flame retardant can be incorporated into the permeability reducing composition and applied as a coating to the wrapper. The permeability reducing composition can contain a reduced ignition substance, such as a natural or synthetic polymer, blended with the phosphorus-based flame retardant. Once applied to the wrapper, the dried coating can contain the phosphorus-based flame retardant generally in an amount greater than about 0.5% by weight, such as in an amount greater than about 1% by weight, such as in an amount greater than about 2% by weight, such as in an amount greater than about 5% by weight, such as in an amount greater than about 10% by weight, such as in an amount greater than about 20% by weight, such as in an amount greater than about 30% by weight, and generally in an amount less than about 50% by weight, such as in an amount less than about 40% by weight, such as in an amount less than about 30% by weight. The reduced ignition substance, on the other hand, can be present in the dried coating in an amount of from about 10% by weight to about 99% by weight, including all increments of 1% by weight therebetween.

When the wrapper of the present disclosure contains the phosphorus-based flame retardant, the wrapper may contain a filler, such as calcium carbonate or magnesium oxide, and may not contain a flame retardant filler.

The uncoated base web can have a diffusivity of less than about 0.8 cm/s, such as less than about 0.7 cm/s, such as less than about 0.6 cm/s. The coated web, on the other hand, can have a diffusivity of less than about 0.2 cm/s, such as less than about 0.15 cm/s, such as less than about 0.1 cm/s.

The wrapper in accordance with the present disclosure can be a single layer wrapper or can include a plurality of layers. For instance, the wrapper can include two layers. When containing a plurality of layers, the base web of the present disclosure comprises one of the layers. In one aspect, for instance, the base web can be the inner layer of a two-layer wrapper or can be the outer layer of a two-layer wrapper.

The present disclosure is also directed to an aerosol delivery product, such as a heat but not burn stick. The heat but not burn stick includes a column of an aerosol generating material. A wrapper as described above surrounds the column of the aerosol generating material. The aerosol generating material can be made from any suitable plant matter. For example, in one embodiment, the aerosol generating material is a tobacco, such as cut tobacco, cast leaf tobacco, or reconstituted tobacco leaf produced through a papermaking process. The aerosol generating material can be in any suitable form, such as aligned or not aligned cut strands, crimped sheets, granules, beads, scraps, or cylindrical shapes. The aerosol generating material can be combined with a humectant for producing an aerosol when heated. The wrapper of the present disclosure can be incorporated into the heat but not burn stick such that the heat but not burn stick is non-combustible when tested according to a combustion test. The heat but not burn stick can pass the above test while having a diameter of from about 5 mm to about 6 mm or from about 6.5 mm to about 9.5 mm.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
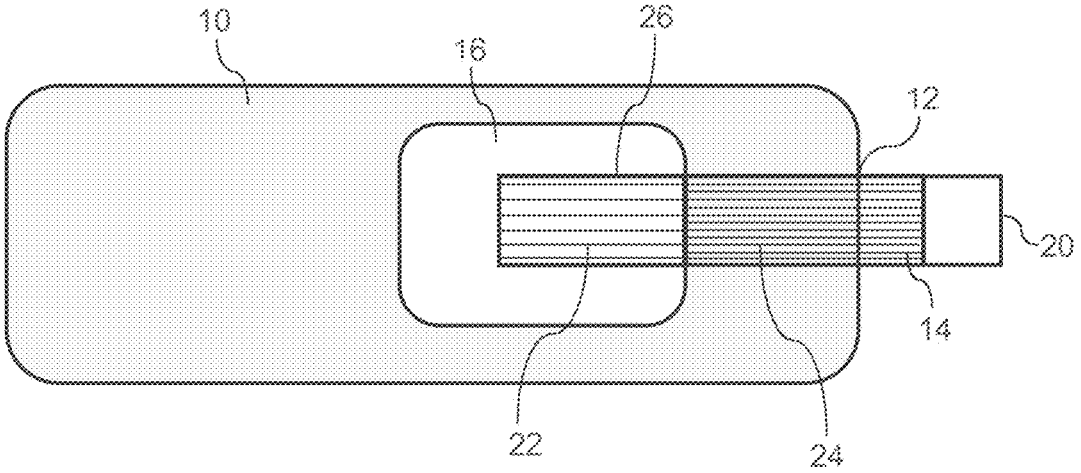
FIG. 1 is a plan view of one embodiment of a heat but not burn device that has been loaded with a heat but not burn stick in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only and is not intended as limiting the broader aspects of the present disclosure.

In general, the present disclosure is directed to a paper product that can be incorporated into all different types of aerosol delivery products. Such products can include heat but not burn sticks, smoking articles, cigarettes, roll your own products and the like. In one application, the wrapper can create a product with low combustion characteristics. For example, the paper product is well suited for use as a wrapper in producing non-combustible heat but not burn sticks.

Producing a wrapper from cellulosic fibers that translates into the capability of creating an aerosol delivery product with low combustion properties is problematic. In the past, in order to produce a wrapper with reduced combustion characteristics, the paper wrapper was combined with a metal film, such as an aluminum film. The present disclosure, however, is directed to a wrapper that does not include a metal foil layer, but still is capable of creating an aerosol delivery product with low combustion characteristics. Various different parameters of the wrapper are adjusted and controlled in combination to produce a wrapper with desired characteristics. In accordance with the present disclosure, for instance, a wrapper is constructed from a cellulosic base web that contains a flame retardant filler at particular levels. In addition, the base web is formed so as to have a relatively high basis weight and have low bulk characteristics. In addition, the base web includes a relatively low inherent permeability and is optionally coated with a permeability reducing composition.

Of particular advantage, a wrapper can be constructed as described above having low combustibility characteristics without interfering with the aerosol generation in a heat but not burn stick. In fact, the wrapper of the present disclosure can offer various advantages and benefits over low combustibility wrappers made in the past. For instance, the wrapper can improve at least one property of a heat but not burn stick in comparison to many past constructions.

In addition, the paper of the present disclosure can be made primarily from biodegradable materials making the wrapper environmentally friendly while providing the desired non-combustible properties for heat but not burn applications.

Referring to FIG. 1, one embodiment of an aerosol generating device that may be used in accordance with the present disclosure is shown. The aerosol generating device 10 includes a passageway or opening 12 for receiving a heat but not burn stick 14. The aerosol generating device 10 includes a heating device 16 that heats but does not burn an aerosol generating material contained within the heat but not burn stick 14. The heating device can comprise any suitable heating device capable of exposing the heat but not burn stick 14 to a temperature sufficient to produce an aerosol. In one aspect, the heating device 16 is a coal tip. The heating device 16, for instance, can comprise an electrical heating element in one embodiment that is powered by a battery and which can be around or inside the aerosol generating material and which can be made of a single or several heating elements. Alternatively, the heating device can produce heat by burning a fuel, such as butane. In still another embodiment, the heating device 16 may include substances that react together in a chemical reaction for producing heat.

As shown in FIG. 1, the heat but not burn stick 14 can have an appearance similar to a conventional cigarette. If desired, the heat but not burn stick 14 can include a mouthpiece or filter 20. The filter 20 can be made from a cellulose acetate tow. In addition to the filter 20, the heat but not burn stick 14 can also include a cooling segment 24. The cooling segment 24 is designed to lower the temperature of an aerosol generated by the heat but not burn stick 14. The aerosol cooling segment 24 can be made from various materials such as cellulose acetate tube, a crimped polylactic acid (PLA) film, or from a perforated paper tube.

The heat but not burn stick 14 further includes a column of an aerosol generating material 22. For example, the aerosol generating material can be a humectant combined with any suitable plant material, such as a tobacco material. The tobacco material can be a single variety of tobacco or can be a variety of tobacco types blended together. The aerosol generating material can be made of natural leaf tobacco, cast leaf tobacco, expanded tobacco, homogenized tobacco, slurry tobacco, papermaking reconstituted tobacco, and combinations thereof. The tobacco material can also be combined with various other non-tobacco materials, such as filler particles.

In addition to tobacco materials, the aerosol generating material can also comprise various other materials, such as various other plant materials. For instance, in other embodiments, the aerosol generating material can be made from hemp including the buds and flowers of the hemp plant. In still another embodiment, the aerosol generating material can comprise other non-tobacco plant materials, such as various herbs and flowers (e.g. a botanical blend).

The aerosol generating material can be in any suitable form, such as aligned or not aligned cut strands, crimped sheets, granules, beads, scraps, or cylindrical shapes.

In accordance with the present disclosure, the heat but not burn stick 14 can further include a wrapper 26 that at least covers the aerosol generating material 22. The wrapper 26 is made in accordance with the present disclosure and has low combustion characteristics. The wrapper 26 can be a single layer of paper or can include two or more layers of paper.

Optionally, the heat but not burn stick 14 can include a tipping paper that covers the filter 20 and optionally the aerosol cooling segment 24.

Figure 2:
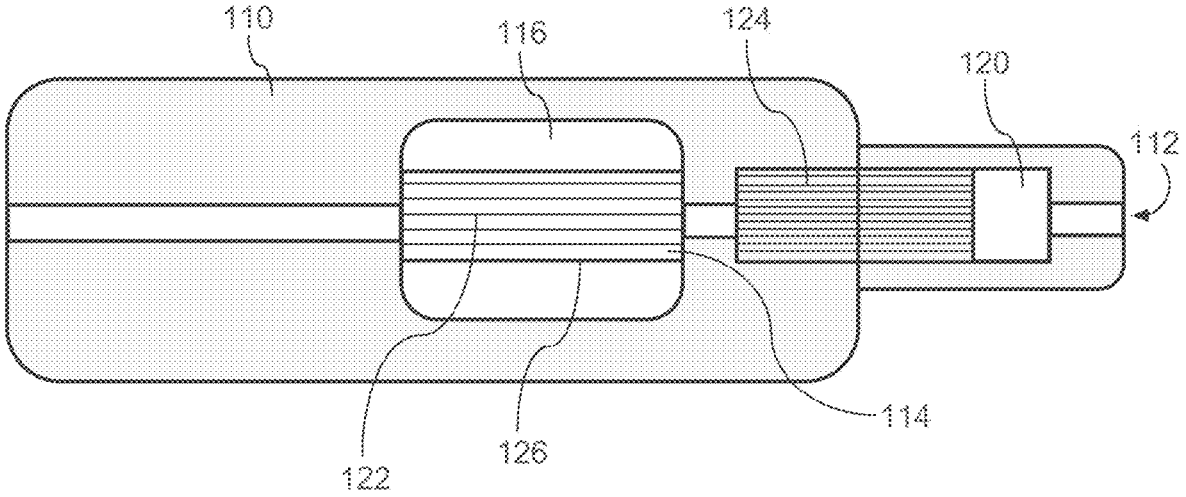
FIG. 2 is a plan view of an alternative embodiment of a heat but not burn device that has been loaded with a heat but not burn stick that includes an aerosol generating material, wherein cooling and filtering functions are part of the heating device.

Referring to FIG. 2, another embodiment of an aerosol generating device 110 is illustrated. In this embodiment, the filter 120 and the aerosol cooling segment 124 are built into the aerosol generating device 110. The aerosol generating device 110 includes an opening 112 or mouthpiece through which a user can receive an aerosol. The aerosol generating device 110 includes a heating device 116 that heats but does not burn a heat but not burn stick 114 that is loaded into the device. In this embodiment, the heat but not burn stick 114 does not include an aerosol cooling segment or a filter. Instead, the heat but not burn stick 114 includes a column of an aerosol generating material 122 that is surrounded by a wrapper 126 in accordance with the present disclosure.

Figure 3:
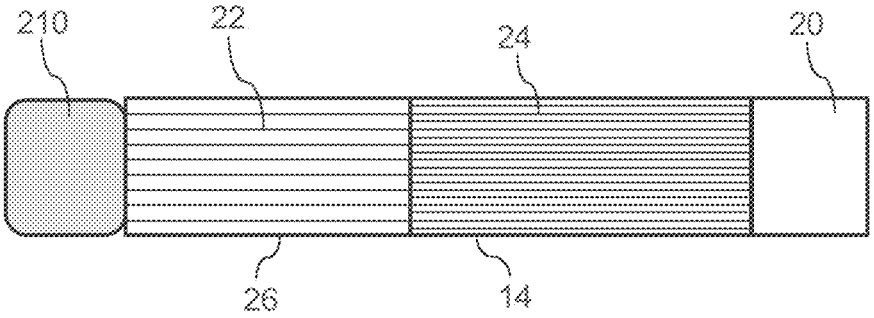
FIG. 3 is still another embodiment of a heat but not burn stick heated by a coal tip without an electrical system.

Referring to FIG. 3, still another embodiment of a heat but not burn device 210 is illustrated. In this embodiment, the heat but not burn stick 14 is substantially the same as the embodiment illustrated in FIG. 1. Thus, like reference numerals have been used to indicate similar elements. The heat but not burn stick 14 includes a filter 20, an aerosol cooling segment 24, and an aerosol generating material 22. The aerosol generating material 22 is surrounded by a wrapper 26 made in accordance with the present disclosure. In this embodiment, the heat but not burn device 210 includes a heating element, such as a coal system, for supplying heat to the heat but not burn stick 14.

The aerosol generating material can contain a humectant for many applications. Humectants that may be used include a polyol, a non-polyol, or mixtures thereof. Polyol humectants include sorbitol, glycerol, propylene glycol, triethylene glycol, or mixtures thereof. Non-polyol humectants include lactic acid, glyceryl diacetate, glyceryl triacetate, triethyl citrate, isopropyl myristate, or mixtures thereof. One or more humectants can be present in the aerosol generating material in an amount from about 3% to about 50% by weight, including all increments of 1% therebetween. When producing heat but not burn sticks, for instance, the aerosol generating material may contain a humectant in an amount greater than about 5% by weight, such as in an amount greater than about 8% by weight, such as in an amount greater than about 10% by weight, such as in an amount greater than about 12% by weight, such as in an amount greater than about 15% by weight, such as in an amount greater than about 17% by weight and generally in an amount less than about 50% by weight, such as in an amount of less than about 30% by weight, such as in an amount less than about 25% by weight, such as in an amount less than about 20% by weight.

In accordance with the present disclosure, the aerosol generating material is surrounded by a wrapper. Once the aerosol generating material is wrapped, the aerosol producing stick can generally have a circumference of from about 4 mm to about 95 mm, such as from about 8 mm to about 30 mm. The length of the stick can generally be from about 1 cm to about 25 cm, such as from about 12 cm to about 20 cm. The diameter of the heat but not burn stick can be from about 4 mm to about 30 mm, such as from about 5 mm to about 9 mm. In one aspect, for instance, the diameter can be from about 5 mm to about 6 mm. In an alternative embodiment, the diameter can be from about 6.5 mm to about 7.5 mm.

The wrapper of the present disclosure as shown in the figures is formed with a combination of different parameters and properties. The wrapper is formed from a cellulosic base web containing a filler, which can be a flame retardant filler, and having a selected basis weight, bulk, permeability, and filler level. In addition, the wrapper can optionally include a coating of a permeability reducing composition that produces a wrapper with a reduced permeability. The wrapper can also optionally include a phosphorus-based flame retardant. The phosphorus-based flame retardant can be contained within the wrapper or can be contained in the coating of the permeability reducing composition. Due to the manner in which the base web is formed, it is believed that the coating and base web have a synergistic relationship with regards to producing a wrapper having the desired low combustion characteristics.

The cellulosic fibers used to form the base web can be formed from softwood fibers, hardwood fibers, bast fibers, mixtures thereof, and the like. Bast fibers that may be used include, for instance, flax fibers, hemp fibers, or combinations thereof. In general, any suitable cellulosic fibers may be used to form the base web. The extent to which the cellulosic fibers are refined can vary depending upon the particular application. In one aspect, the fibers are highly refined, which produces a web with lower permeability characteristics.

In one embodiment, in order to form the base web, the cellulosic fibers are combined with a flame retardant filler and formed into an aqueous suspension. The aqueous suspension is then fed through a headbox and deposited onto a moving forming fabric for forming an embryonic web that is then dried.

The flame retardant filler incorporated into the base web in accordance with the present disclosure can be any suitable filler comprised of particles having low combustibility characteristics. For instance, the flame retardant filler can lower combustion characteristics by absorbing heat, reflecting heat, releasing water, or the like. Examples of filler particles that can be used in accordance with the present disclosure include clay particles, metal hydroxide particles, metal oxide particles, carbonate particles, mixtures thereof, and the like. In one aspect, for instance, the filler particles can comprise clay particles. Clay particles particularly well suited for use in the present disclosure include kaolin particles. Alternatively, the filler particles can comprise silicate particles (e.g. silicate particles not considered clay particles). For instance, the silicate particles may comprise calcium silicate particles. Metal hydroxide particles are also well suited for use in the present disclosure. For example, in one aspect, the filler particles comprise aluminum hydroxide particles. In other embodiments, kaolin particles can be combined with aluminum hydroxide particles and/or silicate particles. In one aspect, the filler particles can further contain calcium carbonate particles, magnesium oxide particles, calcium chloride particles, or the like. Other flame retardant filler particles include alumina tri-hydrate particles, magnesium hydroxide particles, nesquehonite particles, basic magnesium carbonate particles, hydromagnesite particles, sodium dawsonite particles, boehemite particles, magnesium phosphate octahydrate particles, calcium sulphate dihydrate particles, and mixtures thereof. The filler particles can generally have an average particle size of greater than about 0.1 microns, such as greater than about 2 microns, such as greater than about 3 microns, and generally less than about 30 microns, such as less than about 20 microns, such as less than about 10 microns.

The amount of filler particles incorporated into the base web (based on the uncoated web) is generally greater than about 15% by weight, such as greater than about 18% by weight. The filler particles are generally present in an amount less than about 55% by weight, such as in an amount less than about 52% by weight, such as in an amount less than about 50% by weight. In one aspect, filler particles can be present in the base web in an amount from about 15% to about 25% by weight including all increments of 1% therebetween. Alternatively, filler particles can be present in the base web in an amount from about 25% by weight to about 50% by weight, including all increments of 1% therebetween. The type and amount of filler particles incorporated into the base web can depend upon other various properties and physical characteristics of the base web, the type of coating applied to the base web, the diameter of the heat but not burn stick, and the type of filler incorporated into the heat but not burn stick.

The basis weight of the base web can be from about 30 gsm to about 100 gsm, including all increments of 1 gsm therebetween. For instance, the basis weight can be from about 30 gsm to about 85 gsm, such as from about 40 gsm to about 80 gsm, such as from about 45 gsm to about 75 gsm. In one aspect, the basis weight can be from about 33 gsm to about 45 gsm. Alternatively, the basis weight can be from about 45 gsm to about 60 gsm. In still another embodiment, the basis weight can be from about 60 gsm to about 85 gsm, such as from about 65 gsm to about 75 gsm. Basis weight can be determined according to the test method ISO 536:2012. The web is conditioned at 23° C. and 50% relative humidity before the measurement is taken.

In addition to having a basis weight within the above ranges, the base web of the present disclosure also has a relatively low bulk. For example, the bulk can be less than about 2.0 cc/g, such as less than about 1.7 cc/g, such as less than about 1.5 cc/g, such as less than about 1.2 cc/g, such as less than about 1.1 cc/g, such as less than about 1 cc/g, such as less than about 0.95 cc/g. The bulk is generally greater than about 0.6 cc/g, such as greater than about 0.7 cc/g, such as greater than about 0.75 cc/g. Bulk is determined from the thickness and the basis weight. Thickness is determined according to the test method ISO 534:2011. The web is conditioned at 23° C. and 50% relative humidity before the measurement is taken.

Various different methods and techniques can be used in order to produce a base web having a basis weight and bulk as described above. In one aspect, the base web can be formed in a wet lay process. In order to decrease the bulk of the web, during formation, the web can be subjected to significant suction forces during draining of the web in order to compress the web. In addition, during drying of the web, the web can be pushed against a drying cylinder for lowering the bulk of the web. In addition to being formed with low bulk properties, the base web of the present disclosure can also be calendered in order to lower bulk. Calendering, for instance, can occur at a pressure of from about 500 psi to about 2,000 psi, such as from about 800 psi to about 1200 psi.

The base web can have an inherent permeability of less than about 100 mL/min, such as less than about 85 mL/min, such as less than about 70 mL/min, such as less than about 55 mL/min, such as less than about 40 mL/min, such as less than about 30 mL/min, such as less than about 20 mL/min, such as less than about 15 mL/min. As used herein, the "inherent" permeability of the base web refers to the permeability of the base web in an uncoated state such as, for instance, prior to application of a permeability reducing composition. The permeability can be greater than about 5 mL/min, such as greater than about 10 mL/min, such as greater than about 25 mL/min. The permeability can be determined according to the test method ISO 5636-3-2013 and is also referred to the Bendtsen permeability. The permeability can be measured using an L & W Air Permeance Tester, manufactured by Lorentzen & Wettre Products.

The inherent porosity of the base web is generally less than about 15 CU. As used herein, the "inherent" porosity of the base web refers to the porosity of the base web in an uncoated state. The porosity and permeability of the base web can be controlled using various different techniques. For instance, the porosity and permeability of the base web can be reduced by increasing the amount the cellulosic fibers are refined and/or decreasing the particle size of the one or more fillers. In one aspect, the porosity of the base web is relatively low which can further improve the non-combustibility characteristics of the wrapper. For instance, the porosity can be less than about 9 CU, such as less than about 8 CU, such as less than about 7 CU, such as less than about 6 CU, such as less than about 5 CU, such as less than about 4 CU. The porosity is generally about 0 CU or greater, such as greater than about 2 CU.

The base web of the present disclosure can also be treated or contain various different additives in order to improve properties or characteristics. Alternatively, the wrapper can be constructed without any further additives or components. For example, the wrapper can be free of burn control agents, such as an alkali metal salt of a carboxylic acid, an alkaline earth metal salt of a carboxylic acid, or mixtures thereof.

In accordance with the present disclosure, base webs as described above can be further optionally treated with a permeability reducing composition. For instance, a coating can be disposed on one side or both sides of the base web comprising the permeability reducing composition.

In general, any suitable permeability reducing composition can be applied to the base web. In one embodiment, for instance, the permeability reducing composition contains a natural or synthetic polymer. For example, reduced ignition substances that can be used in accordance with the present disclosure include alginates, guar gum, pectin, polyvinyl alcohol, polyvinyl acetate, cellulose derivatives such as ethyl cellulose, methyl cellulose, and carboxymethyl cellulose, starch, starch derivatives, and mixtures thereof. The reduced ignition substance can also comprise other cellulose-based materials, such as cellulose particles, cellulose fibers or microcrystalline cellulose including colloidal microcrystalline cellulose (gel).

In one particular embodiment, the reduced ignition substance may comprise an alginate, alone or in combination with starch. In general, an alginate is a derivative of an acidic polysaccharide or gum which occurs as the insoluble mixed calcium, sodium, potassium and magnesium salt in the Phaeophyceae brown seaweeds. Generally speaking, these derivatives are calcium, sodium, potassium, and/or magnesium salts of high molecular weight polysaccharides composed of varying proportions of D-mannuronic acid and L-guluronic acid. Exemplary salts or derivatives of alginic acid include ammonium alginate, potassium alginate, sodium alginate, propylene glycol alginate, and/or mixtures thereof.

In one embodiment, a relatively low molecular weight alginate may be used. For example, the alginates may have a viscosity of less than about 500 cP when contained in a 3% by weight aqueous solution at 25° C. More particularly, the alginates may have a viscosity of less than 250 cP at the above conditions, particularly less than 100 cP, and in one embodiment at a viscosity of about 20-60 cP. As used herein, viscosity is determined by a Brookfield LVF Viscometer with a suitable spindle according to the viscosity. At the above lower viscosity levels, alginate compositions can be formed at a higher solids content, but yet at a low enough solution viscosity to permit the application of the composition to the base web using conventional techniques. For example, the solids content of an alginate solution made in accordance with the present disclosure can be greater than about 6%, particularly greater than about 10%, and more particularly from about 10% to about 20% by weight.

At the above solids levels, alginate compositions can have a solution viscosity of greater than about 250 cP, particularly greater than about 500 cP, more particularly greater than about 800 cP, and in one embodiment at a viscosity of greater than about 1,000 cP at 25° C. In general, the solution viscosity of the alginate composition can be adjusted depending upon the manner in which the composition is being applied to the base web. For instance, the solution viscosity of the composition can be adjusted depending upon whether or not the composition is being sprayed onto the paper or printed onto the paper.

In other embodiments, it should also be understood that depending upon the application a relatively high molecular weight alginate may be used. For example, the alginate may have a viscosity of greater than about 500 cP when contained in a 3% by weight aqueous solution at 25° C.

In an alternative embodiment, the reduced ignition substance can comprise a starch, which also includes starch derivatives. Starch can also be referred to as amylum and is a polymeric carbohydrate.

In still another embodiment, the reduced ignition substance can be a cellulose derivative, such as carboxymethyl cellulose.

Other cellulose materials that can be used include a cellulose slurry or a cellulose gel, such as a microcrystalline cellulose. The cellulose material applied to the base web may comprise fibrous cellulose, one or more fillers, and/or cellulose particles. As used herein, cellulose fibers and cellulose particles are to be differentiated from derivatized cellulose such as carboxymethyl cellulose. Cellulose fibers and cellulose particles, for instance, are not completely water soluble.

In one embodiment, a cellulose material, such as microcrystalline cellulose, can be combined with one of the other ignition reducing substances identified above such as an alginate, a starch, carboxymethyl cellulose, or mixtures thereof.

In addition to an alginate, a starch, guar gum, pectin, polyvinyl alcohol, polyvinyl acetate, a cellulose derivative, a microcrystalline cellulose, cellulose fibers or particles, a starch derivative, or mixtures thereof, the permeability reducing composition applied to the base web can contain various other ingredients. For instance, in one embodiment, a filler can be contained within the composition as described above. The filler can be, for instance, calcium carbonate, calcium chloride, calcium lactate, calcium silicate, calcium gluconate, and the like. In addition to calcium compounds, other various particles may be used including magnesium compounds such as magnesium oxide, clay particles, and the like.

In one embodiment, the permeability reducing composition can also contain a phosphorus-based flame retardant. In general, any suitable phosphorus-based flame retardant may be incorporated into the coating formed from the permeability reducing composition, such as an organophosphorus compound. When incorporated into the coating, the phosphorus-based flame retardant can be water soluble or water insoluble. In one aspect, the phosphorus-based flame retardant can be a phosphate salt, such as an alkali salt, an alkaline earth metal salt, an ammonium salt, other metal salts, and mixtures thereof. The phosphate-based flame retardant can be a monophosphate, a diphosphate, or a polyphosphate. In still another aspect, the phosphate-based flame retardant can be a hydrogen phosphate. For instance, the phosphorus-based flame retardant may include a sodium phosphate, a potassium phosphate, or an ammonium phosphate. In one aspect, the phosphorus-based flame retardant can be a phosphorus salt of a monocarboxylic acid, a dicarboxylic acid, and/or a tricarboxylic acid and at least one polyphosphoric, pyrophosphoric and/or phosphoric acid. In still another aspect, the phosphorus-based flame retardant can be a hydroxide that forms a phosphate. In still another embodiment, the phosphorus-based flame retardant can be cellulose modified with a phosphorylated linseed oil or a phosphorylated corn oil.

Particular examples of phosphorus-based flame retardants include monosodium phosphate, disodium phosphate, monoammonium phosphate, monopotassium phosphate, dipotassium phosphate, and mixtures thereof. Still other examples include sodium polyphosphate, potassium polyphosphate, and/or ammonium polyphosphate.

One or more phosphorus-based flame retardants can be incorporated into the permeability reducing composition such that a dried coating made from the composition contains one or more phosphorus-based compounds in an amount greater than about 0.5% by weight, such as in an amount greater than about 1% by weight, such as in an amount greater than about 2% by weight, such as in an amount greater than about 3% by weight, such as in an amount greater than about 5% by weight, such as in an amount greater than about 10% by weight, such as in an amount greater than about 15% by weight, such as in an amount greater than about 20% by weight, such as in an amount greater than about 25% by weight, such as in an amount greater than about 30% by weight, such as in an amount greater than about 35% by weight, such as in an amount greater than about 40% by weight, such as in an amount greater than about 45% by weight. One or more phosphorus-based flame retardants can be present in the dried coating in an amount generally less than about 55% by weight, such as in an amount less than about 50% by weight, such as in an amount less than about 40% by weight, such as in an amount less than about 30% by weight, such as in an amount less than about 20% by weight, such as in an amount less than about 10% by weight, such as in an amount less than about 8% by weight, such as in an amount less than about 5% by weight, such as in an amount less than about 3% by weight.

Once dried, the coating formed from the permeability reducing composition can contain one or more reduced ignition substances in an amount generally from about 3% by weight to 100% by weight, including all increments of 1% by weight therebetween. For instance, one or more reduced ignition substances can be present in the dried coating in an amount greater than about 10% by weight, such as in an amount greater than about 20% by weight, such as in an amount greater than about 30% by weight, such as in an amount greater than about 40% by weight, such as in an amount greater than about 50% by weight, such as in an amount greater than about 60% by weight, such as in an amount greater than about 70% by weight, and generally in an amount less than about 90% by weight, such as in an amount less than about 80% by weight, such as in an amount less than about 70% by weight, such as in an amount less than about 60% by weight, such as in an amount less than about 50% by weight.

The permeability reducing composition, in one embodiment, can be water based. In particular, the permeability reducing composition may comprise an aqueous dispersion, an aqueous gel, or an aqueous solution. Alternatively, the permeability reducing composition prior to being applied to the paper wrapper may comprise a non-aqueous gel, solution or dispersion. In this embodiment, for instance, an alcohol may be present for applying the composition to the wrapper.

The permeability reducing composition can be applied to the base web using any suitable technique in order to form a coating. For instance, the permeability reducing composition can be sprayed, brushed, applied with a moving orifice, or printed onto the base web. In one aspect, the permeability reducing composition is applied to the base web using gravure printing. The coating can be formed by applying the permeability reducing composition in a single pass onto the base web or using a multiple pass operation.

The amount that one side of the base web is coated can vary depending upon the particular application. In one embodiment, the permeability reducing composition forms a continuous coating over a surface of the base web. For instance, the coating can cover greater than about 20% of the surface area of one side of the web, such as greater than about 40% of the surface area, such as greater than about 50% of the surface area, such as greater than about 65% of the surface area, such as greater than about 80% of the surface area, such as greater than about 85% of the surface area, such as greater than about 90% of the surface area, such as greater than about 95% of the surface area, such as greater than about 98% of the surface area of one side of the base web. In one particular embodiment, the permeability reducing composition can cover 100% of the surface area of one side of the base web.

Alternatively, the coating can be applied in discrete areas to one side of the base web. In this manner, the base web includes treated areas and untreated areas with the permeability reducing composition. The permeability reducing composition, for instance, can be applied to a surface of the base web in any particular pattern. For example, in one embodiment, the permeability reducing composition can be applied to the base web in the form of circumferential bands having a width of from about 3 mm to about 20 mm. When applied in a discontinuous manner, the permeability reducing composition can cover greater than about 20%, such as greater than about 30%, such as greater than about 40%, such as greater than about 50%, such as greater than about 60%, such as greater than about 70% of the surface area of one side of the base web. When applied in a discontinuous manner, the permeability reducing composition can cover less than about 90%, such as less than about 80% of the surface area of one side of the base web.

In general, the permeability reducing composition can be applied to the base web in an amount greater than about 0.5 gsm (the dried coating weight). The above amounts are directed to areas where the base web is coated. For instance, the coating can have a basis weight of greater than about 1 gsm, such as greater than about 4 gsm, such as greater than about 6 gsm, such as greater than about 8 gsm, and generally less than about 10 gsm, such as less than about 7 gsm, such as less than about 5 gsm. In one embodiment, the coating has a basis weight (where applied to the base web) of from about 1 gsm to about 5 gsm.

Once coated, the base web or wrapper can have a relatively low permeability and porosity within the coated areas. For example, within the coated areas, the permeability can be less than about 25 mL/min, such as less than about 20 mL/min, such as less than about 15 mL/min, such as less than about 10 mL/min, such as less than about 5 mL/min, and generally greater than about 0, such as greater than about 0.1 mL/min, such as greater than about 1 mL/min.

Within the coated areas, the porosity of the base web can be less than about 3 CU, such as less than about 2 CU.

In addition to having a relatively low porosity, the coated areas of the base web or wrapper also have a relatively low diffusivity. The diffusivity can be measured at room temperature (23° C.). In general, the diffusivity at 23° C. of the coated areas of the base web or wrapper is less than about 0.2 cm/s, such as less than about 0.15 cm/s, such as less than about 0.1 cm/s, such as less than about 0.08 cm/s, such as less than about 0.07 cm/s. The diffusivity in the coated areas is zero or generally greater than about 0.02 cm/s and in one aspect greater than about 0.1 cm/s. Diffusivity is measured using a Sodim $CO_2$ diffusivity tester. The uncoated paper can have a diffusivity of generally greater than about 0.3 cm/s, such as greater than about 0.4 cm/s, such as greater than about 0.5 cm/s, and generally less than about 0.8 cm/s, such as less than about 0.7 cm/s, such as less than about 0.6 cm/s.

Papers made in accordance with the present disclosure are well suited for use as wrappers for aerosol delivery products, such as heat but not burn sticks. As described above, the paper can be constructed so that the aerosol delivery product is non-combustible. When incorporated into a wrapper, the wrapper can contain a single layer made from the paper or can include a plurality of layers, such as two layers. For example, in one embodiment, the wrapper can include two layers and the paper of the present disclosure can be the inner layer surrounded by an outer layer. Alternatively, the coated paper can be the outer layer surrounding an inner layer. When used in a two layer construction, the wrapper of the present disclosure may have a reduced basis weight. For example, the basis weight of the base web can be from about 20 gsm to about 100 gsm, including all increments of 1 gsm therebetween. For instance, the basis weight can be from about 20 gsm to about 80 gsm.

The paper wrapper that is used in conjunction with the paper of the present disclosure to form a two-layer wrapper can vary depending upon the particular circumstances and desired result. For example, the opposing layer can be made from cellulosic fibers and can contain a filler, such as a white filler made from calcium carbonate or magnesium oxide. The paper can also contain a binder, such as carboxymethyl cellulose, guar gum, or mixtures thereof. An optical brightener can also be incorporated into the paper.

Once a wrapper in accordance with the present disclosure is incorporated into a heat but not burn stick, the heat but not burn stick can be tested for combustibility.

In still another embodiment, instead of being incorporated into a coating applied to the wrapper, a phosphorus-based flame retardant can be incorporated throughout the thickness of the wrapper by being combined with the cellulose fibers used to form the wrapper. For example, in one embodiment, one or more phosphorus-based flame retardants can be impregnated into the wrapper. When impregnated into the wrapper, the phosphorus-based flame retardant can be water soluble and applied to the wrapper as an aqueous solution while the wrapper is being made. For instance, the phosphorus-based flame retardant can be a sodium phosphate, a potassium phosphate, or ammonium phosphate including monophosphates, diphosphates, and polyphosphates. It should be understood, however, that any of the phosphorus-based flame retardants described above can be incorporated into the wrapper with the cellulose fibers.

The phosphorus-based flame retardant can be applied to the wrapper using any suitable method or technique. For example, the phosphorus-based flame retardant can be combined in an aqueous solution and applied by spraying, dipping, or printing using, for instance, flexographic printing, gravure printing, or the like. Especially when using printing techniques, the phosphorus-based flame retardant can be applied in certain areas according to a pattern that includes treated areas and untreated areas or can be applied uniformly over the entire surface area of the wrapper.

In one embodiment, the phosphorus-based flame retardant is contained in an aqueous solution and applied to the wrapper using a size press as the wrapper is being formed. Incorporating the phosphorus-based flame retardant into the wrapper using a size press can provide various efficiencies and can ensure that the phosphorus-based flame retardant is impregnated throughout the wrapper.

When incorporated into the interior of the wrapper, the amount of the phosphorus-based flame retardant applied to the wrapper can vary depending upon the particular application and the desired result. In general, the phosphorus-based flame retardant is applied in an amount greater than about 1 $mg/m^2$ to about 10 gsm. For example, in one embodiment, relatively small amounts are incorporated into the wrapper in amounts from about 1 $mg/m^2$ to about 20 $mg/m^2$. In an alternative embodiment, one or more phosphorus-based flame retardants are incorporated into the wrapper in an amount greater than about 0.5 gsm, such as greater than about 1 gsm, such as greater than about 1.5 gsm, and generally less than about 10 gsm, such as less than about 8 gsm, such as less than about 6 gsm.

Various different wrappers can be made in accordance with the present disclosure using the techniques described above. For example, in one embodiment, the wrapper can include a flame retardant filler in combination with a phosphorus-based flame retardant, but can be uncoated. In an alternative embodiment, the wrapper can include a coating formed from a permeability reducing composition. The coating can be used in conjunction with a flame retardant filler, a phosphorus-based flame retardant, or can be combined with both a flame retardant filler and a phosphorus-based flame retardant. In this embodiment, the phosphorus-based flame retardant can be impregnated into the wrapper, can be applied with the coating, or can be contained in the coating and also incorporated into the wrapper.

In still another alternative embodiment, the wrapper of the present disclosure includes a coating formed from a permeability reducing composition in combination with at least one phosphorus-based flame retardant. The phosphorus-based flame retardant can be contained in the coating, can be impregnated into the paper, or can be both contained in the coating and impregnated into the paper. In this embodiment, the wrapper may contain no flame retardant fillers but may contain other fillers, such as calcium carbonate or magnesium oxide. Alternatively, the wrapper can contain a flame retardant filler.

In one aspect, the heat but not burn sticks can be tested according to ISO 3308:2012. smoking regime conditions. In order to test for combustibility, two sets of 20 heat but not burn sticks can be placed in a Borgwaldt RM20 kit machine and tested. The smoking machine is smoked with a puff volume of 35 mL±0.3 for a puff duration of 2 seconds. The puff frequency is every 60 seconds with no vent blocking. The heat but not burn stick is inserted into the stick holder of the machine and lit with the first puff. If the combustion does not restart with the second puff, the heat but not burn stick is considered to be non-combustible.

A second test is conducted according to ISO 20778:2018 smoking regime conditions in which the puff volume is 55 mL±0.6 and the puff frequency is every 30 seconds (HCl test). In addition, the HCl test is conducted with double wrapper sticks as opposed to single wrapper sticks. The puff duration is 2 seconds without vent blocking. Heat but not burn sticks made according to the present disclosure can be considered non-combustible under each of the above tests.

The present disclosure may be better understood with reference to the following examples.

Example No. 1

Various different tobacco wrappers were made and incorporated into a heat but not burn stick.

In this example, the aerosol generating material contained within the heat but not burn stick was a commercially available tobacco material. The tobacco material was a papermaking reconstituted tobacco. Leaflets were cut and then the cut filler was wrapped with the wrapper. The sticks had a diameter of 7 mm and did not contain a filter.

Wrappers were made according to the present disclosure containing wood pulp fibers combined with various different filler types. A coating was disposed on the first side of each base web comprising a permeability reducing composition. Various different permeability reducing compositions were used. The coated wrapper had a porosity of less than 2 CU and was calendered so as to have a bulk of less than 1.1 cc/g.

The following wrappers were made:

| Sample No. | Grammage (gsm) | Filler content | Filler type | Coating |
|---|---|---|---|---|
| 1 | 70 | 20% | Kaolin | alginate |
| 2 | 50 | 20% | Kaolin | alginate |
| 3 | 70 | 50% | Al(OH)3 | alginate |
| 4 | 70 | 50% | Al(OH)3 | starch |
| 5 | 70 | 30% | Al(OH)3 | microcrystalline cellulose gel |
| 6 | 50 | 50% | Al(OH)3 | starch |
| 7 | 50 | 50% | Al(OH)3 | microcrystalline cellulose gel |
| 8 | 70 | 20% | Kaolin | microcrystalline cellulose gel |
| 9 | 50 | 30% | Al(OH)3 | alginate |
| 10 | 36 | 20% | Kaolin | starch |
| 11 | 70 | 30% | Al(OH)3 | starch |
| 12 | 36 | 20% | Kaolin | microcrystalline cellulose gel |
| 13 | 50 | 20% | Kaolin | starch |
| 14 | 70 | 25% | silicate calcium | alginate |
| 15 | 35 | 25% | silicate calcium | microcrystalline cellulose gel |
| 16 | 50 | 30% | Al(OH)3 | starch |
| 17 | 50 | 25% | silicate calcium | alginate |
| 18 | 50 | 25% | silicate calcium | microcrystalline cellulose gel |
| 19 | 70 | 25% | silicate calcium | microcrystalline cellulose gel |

The heat but not burn sticks were placed in smoking machines and the combustibility characteristics of the sticks were visually observed. The samples in the table above are ranked according to the visual observations. Although all of the wrappers displayed low combustion properties, samples 1 through 9 displayed the best results.

Example No. 2

Two further wrappers were made in accordance with the present disclosure and tested for various properties. More particularly, the following wrappers were constructed and the below properties were measured.

| Sample No. | Basis weight | Filler | % Filler | Calendering | Coating |
|---|---|---|---|---|---|
| 20 | 70 | Al(OH)3 | 30 | 1000 psi 10 rpm | Alginate |
| 21 | 50 | Al(OH)3 | 30 | 1000 psi 10 rpm | Alginate |

| | | Sample No. 20 | Sample No. 21 |
|---|---|---|---|
| Basis weight (gsm) | Base | 73 | 53 |
| | After calendering | 73 | 53 |
| | After coating | 75 | 55 |
| Thickness (μm) | Base | 108 | 83 |
| | After calendering | 65 | 49 |
| | After coating | 71 | 52 |
| Bulk (cc/g) | After calendering | 0.9 | 0.9 |
| Porosity (CU) | Base | 13 | 22 |
| | After calendering | 3 | 4 |
| | After coating | 1 | 1 |
| Permeability (ml/min) | Base | 187 | 318 |
| | After calendering | 36 | 55 |
| | After coating | 11 | 4 |
| Diffusivity (cm/s) | Base | 0.950 | 1.341 |
| | After calendering | 0.418 | 0.560 |
| | After coating | 0.066 | 0.133 |

Example No. 3

In this example, additional wrappers were made in accordance with the present disclosure containing wood pulp fibers. More particularly, the following samples were constructed in order to demonstrate some of the benefits and advantages of impregnating the wrapper with a phosphorus-based flame retardant and with combining the phosphorus-based flame retardant with the coating material (Sample Nos. 27 and 28). The following samples were constructed:

| Sample No. | Basis weight (gsm) | Filler | % Filler | Alginate Coating (gsm) | $NaH_2PO_4$ (gsm) | Thickness μm | Bulk Cc/g | Perme-ability ml/min | Perme-ability CU | ISO (single wrap) | HCl (double wrap) |
|---|---|---|---|---|---|---|---|---|---|---|---|
| 22 | 37.6 | Aluminum hydroxide | 23 | NA | 2.1 | 52.7 | 1.4 | 51 | 5 | 5 | 10 |
| 23 | 39.4 | Aluminum hydroxide | 23 | NA | 3.9 | 56.3 | 1.4 | 49 | 5 | 2 | 7 |
| 24 | 40.8 | Aluminum hydroxide | 23 | NA | 5.3 | 53.3 | 1.3 | 37 | 4 | 1 | 4 |
| 25 | 38.2 | Aluminum hydroxide | 24 | Alginate/Starch 70/30 (3 gsm) | 3.6 | 47.3 | 1.2 | 3 | 1 | 1 | 2 |
| 26 | 33.2 | Calcium carbonate | 10 | NA | 5.9 | 45 | 1.4 | 121 | 10 | 1 | 5 |
| 27 | 36.1 | Aluminum hydroxide | 24 | Alginate (2.2 gsm) | 2.2 | 44 | 1.2 | — | 2 | 3 | — |
| 28 | 46.3 | Aluminum hydroxide | 18 | Alginate (1.9 gsm) | 1.9 | 57 | 1.2 | — | 2 | 3 | — |

As shown above with respect to Sample Nos. 22-24, the non-combustible characteristics of the wrapper improve as the amount of the phosphorus-based flame retardant is increased. As shown by Sample Nos. 24 and 25, the addition of a coating generally improves the non-combustibility characteristics. Sample No. 26 demonstrates that a phosphorus-based flame retardant impregnated into the wrapper in combination with a calcium carbonate filler can demonstrate good non-combustibility characteristics. Sample Nos. 27 and 28 demonstrate that a phosphorus-based flame retardant combined with the coating material is also effective.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only and is not intended to limit the invention so further described in such appended claims.

What is claimed:

1. A wrapper for a heat but not burn stick comprising:

a base web comprising cellulosic fibers combined with a flame retardant filler, the base web having a first side and a second and opposite side, the flame retardant filler being present in the base web in an amount of from about 18% to about 55% by weight, the base web having a bulk of less than about 1.7 cc/g, a basis weight of greater than 50 gsm to about 85 gsm, and having a permeability of about 55 mL/min or less.

2. A wrapper as defined in claim 1, further comprising a coating disposed on the first side of the base web, the coating comprising a permeability reducing composition.

3. A wrapper as defined in claim 2, wherein the coating of the permeability reducing composition is continuous, the first side of the base web having a surface area and wherein the coating covers greater than about 20% of the surface area of the first side of the base web.

4. A wrapper as defined in claim 2, wherein the coated base web has a permeability of less than about 20 mL/min.

5. A wrapper as defined in claim 2, wherein the permeability reducing composition comprises a microcrystalline cellulose, an alginate, a starch, a carboxyl methylcellulose, or mixtures thereof.

6. A wrapper as defined in claim 2, wherein the coating further comprises a phosphorus-based flame retardant.

7. A wrapper as defined in claim 1, wherein the flame retardant filler comprises silicate particles or clay particles.

8. A wrapper as defined in claim 1, wherein the flame retardant filler comprises kaolin particles.

9. A wrapper as defined in claim 1, wherein the flame retardant filler comprises aluminum hydroxide particles.

10. A wrapper as defined in claim 1, wherein the flame retardant filler comprises particles having an average particle size of from about 0.1 microns to about 30 microns.

11. A wrapper as defined in claim 1, wherein the base web has been calendered.

12. A wrapper as defined in claim 1, wherein the base web has a bulk of less than about 1.3 cc/g.

13. A wrapper as defined in claim 1, wherein the base web has a permeability of less than about 30 mL/min.

14. A wrapper as defined in claim 1, wherein the flame retardant filler comprises kaolin particles, aluminum hydroxide particles, or mixtures thereof.

15. A wrapper as defined in claim 1, wherein the wrapper is a single layer wrapper.

16. A wrapper as defined in claim 1, wherein the wrapper includes a plurality of layers, the base web comprising one of the layers.

17. A wrapper as defined in claim 1, wherein the wrapper further comprises a phosphorus-based flame retardant.

18. A wrapper as defined in claim 17, wherein the phosphorus-based flame retardant is impregnated into the base web.

19. A wrapper as defined in claim 17, wherein the phosphorus-based flame retardant comprises a sodium phosphate, a potassium phosphate, an ammonium phosphate, or mixtures thereof.

20. A wrapper for a heat but not burn stick comprising:

a base web comprising cellulosic fibers combined with a filler, the base web having a first side and a second and opposite side, the filler being present in the base web in an amount of from about 18% to about 55% by weight, the base web having a bulk of less than about 1.7 cc/g, a basis weight of greater than 50 gsm to about 85 gsm, and having a permeability of about 55 mL/min or less, and wherein the wrapper further comprises a coating disposed on the first side of the base web, the coating comprising a permeability reducing composition combined with a phosphorus-based flame retardant.

21. An aerosol delivery product comprising:

a column of an aerosol generating material; and a wrapper as defined in claim 1, the wrapper surrounding the column of the aerosol generating material.

* * * * *